US007416415B2

(12) United States Patent
Hart et al.

(10) Patent No.: US 7,416,415 B2
(45) Date of Patent: Aug. 26, 2008

(54) MULTIPLE POSITION PUSH-ON ELECTRICAL CONNECTOR AND A MATING CONNECTOR THEREFOR

(75) Inventors: Dennis Francis Hart, Phoenix, AZ (US); Casey Roy Stein, Scottsdale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 11/451,778

(22) Filed: Jun. 12, 2006

(65) Prior Publication Data

US 2007/0287328 A1 Dec. 13, 2007

(51) Int. Cl.
*H01R 9/05* (2006.01)

(52) U.S. Cl. ..... 439/63; 439/579

(58) Field of Classification Search ..... 439/63, 439/579, 581

See application file for complete search history.

(56) References Cited

U.S. PATENT DOCUMENTS

| | | | | | |
|---|---|---|---|---|---|
| 3,825,874 | A * | 7/1974 | Peverill | 439/579 |
| 3,852,700 | A * | 12/1974 | Haws | 439/98 |
| 4,895,521 | A | 1/1990 | Grabbe | 439/63 |
| 5,203,717 | A | 4/1993 | Beck et al. | 439/460 |
| 5,273,443 | A | 12/1993 | Frantz et al. | 439/595 |
| 5,295,863 | A | 3/1994 | Cady | 439/578 |
| 5,397,241 | A * | 3/1995 | Cox et al. | 439/79 |
| 5,611,707 | A | 3/1997 | Meynier | 439/353 |
| 5,718,592 | A * | 2/1998 | Hosler et al. | 439/63 |
| 5,890,926 | A | 4/1999 | Pauza et al. | 439/445 |
| 5,906,511 | A | 5/1999 | Bozzer et al. | 439/579 |
| 6,071,127 | A | 6/2000 | Acke et al. | 439/63 |
| 6,144,561 | A * | 11/2000 | Cannella et al. | 361/796 |
| 6,338,653 | B1 | 1/2002 | Jones et al. | 439/579 |
| 6,386,913 | B1 * | 5/2002 | Mohammad et al. | 439/579 |
| 6,547,593 | B1 | 4/2003 | Beckous | 439/581 |
| 6,555,754 | B2 * | 4/2003 | Gilmour | 174/151 |
| 6,692,262 | B1 | 2/2004 | Loveless | 439/63 |
| 6,827,608 | B2 | 12/2004 | Hall et al. | 439/578 |
| 6,945,795 | B1 * | 9/2005 | Gross, III et al. | 439/92 |
| 2004/0038586 | A1 | 2/2004 | Hall et al. | 439/578 |
| 2004/0092165 | A1 | 5/2004 | Holland | 439/607 |
| 2006/0051997 | A1 | 3/2006 | Kooiman | 439/180 |
| 2006/0084286 | A1 | 4/2006 | Kooiman | 439/63 |

FOREIGN PATENT DOCUMENTS

| | | |
|---|---|---|
| EP | 0582960 | 8/1993 |
| WO | WO98/33243 | 7/1998 |

* cited by examiner

*Primary Examiner*—Gary F. Paumen
(74) *Attorney, Agent, or Firm*—Joseph M. Homa; Matthew J. Mason

(57) ABSTRACT

A multiple position push-on electrical connector has a housing and at least two sets of bores extending through the housing. The connector also includes a plurality of electrical conductors that extend beyond a first face of the connector and are electrically insulated from the housing. The electrical conductors are capable of transmitting DC signals through the connector. A multiple position push-on electrical mating connector has housing, a first set of bores extending through the housing and a plurality of electrical conductors for transmitting DC signals through the housing. The two connectors are preferably configured to mate with one another and communicate with a device to which the multiple position push-on electrical connector is connected.

17 Claims, 6 Drawing Sheets

MULTIPLE POSITION PUSH-ON ELECTRICAL CONNECTOR AND A MATING CONNECTOR THEREFOR

BACKGROUND OF THE INVENTION

1. Field of the Invention

This invention relates to push-on electrical connectors, and more particularly to an electrical connector system having a plurality of push-on style interfaces and connectors that provide both signals and power through the same connector.

2. Technical Background

Typically the connectors used in RF and high speed digital electronic systems are push-on style connectors. However, the connectors are typically single-position connectors and a plurality of the single-position connectors are needed for any single application. Thus, the single position connectors are cumbersome and inconvenient in those applications needing multiple connectors. While there are multi-position connector blocks that provide multiple RF connectors for these applications, the multi-position connector blocks do not provide any means for making the requisite DC power (and the attendant low frequency signals associated therewith) connections with the devices, including electronic modules, boards, housings, and substrates.

In order to make the requisite DC power connections, single connections with the devices are typically made in addition to the RF connectors. Making these DC power connections with the electronic modules can be time consuming, expensive and ineffective.

SUMMARY OF THE INVENTION

To achieve these and other advantages and in accordance with the purpose of the invention as embodied and broadly described herein, the invention is directed in one aspect to a multiple position push-on electrical connector that includes a housing having a first face and a second face, a first set of bores extending through the housing between the first face and the second face, the first set of bores configured to receive coaxial cables therein, a second set of bores extending through the housing between the first face and second face, and a plurality of electrical conductors secured in the second set of bores, each of the plurality of electrical conductors extending beyond the first face of the housing and being electrically insulated from the housing, the plurality of electrical conductors capable of transmitting DC signals through the connector.

In another aspect, disclosed herein is a multiple position push-on electrical mating connector that includes a housing having a first face and a second face, a first set of bores extending through the housing between the first face and the second face, each of the first set of bores configured to receive coaxial cable through the first face and having a male connector interface accessible through the second face, and a plurality of electrical conductors extending between the first face and the second face for transmitting DC signals through the housing.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
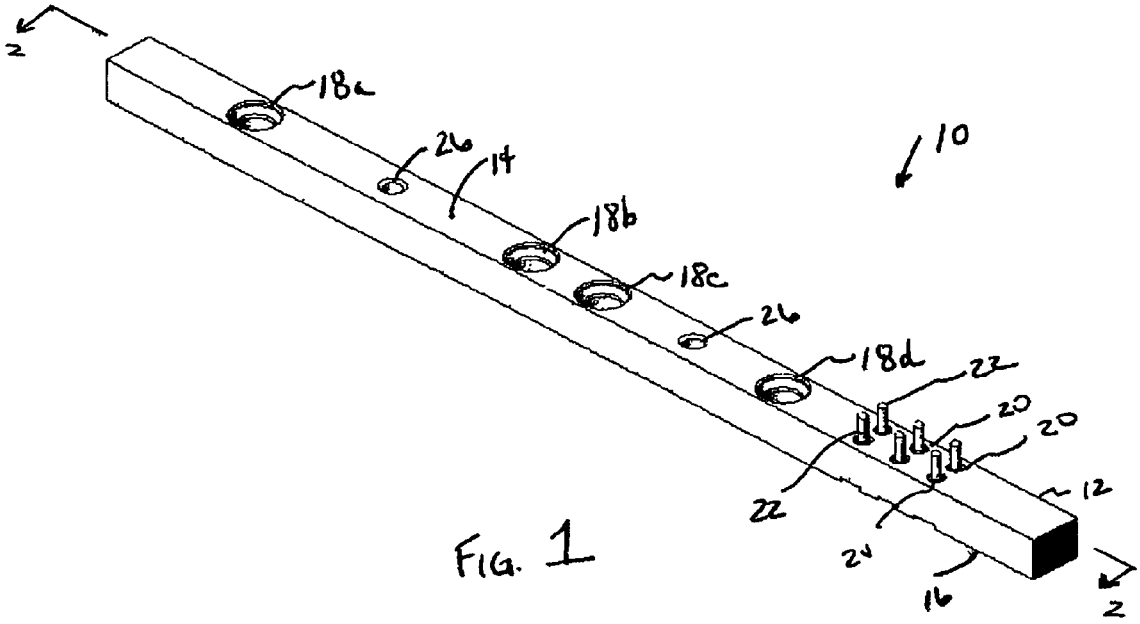
FIG. 1 is a perspective view of multiple position push-on electrical connector according to the present invention.

Reference will now be made in detail to the present preferred embodiment(s) of the invention, examples of which are illustrated in the accompanying drawings. Whenever possible, the same reference numerals will be used throughout the drawings to refer to the same or like parts. One embodiment of the present invention is shown in FIG. 1 and is designated generally throughout by the reference numeral 10.

Figure 2:
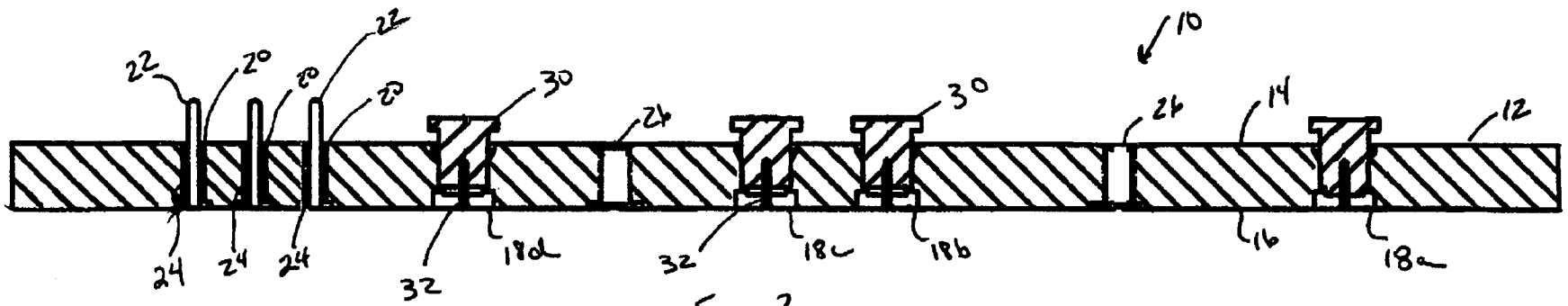
FIG. 2 is a cross section view of the multiple position push-on electrical connector of FIG. 1 along the line 2-2 with alignment plugs having electrical conductors in the first set of bores.
Figure 3:
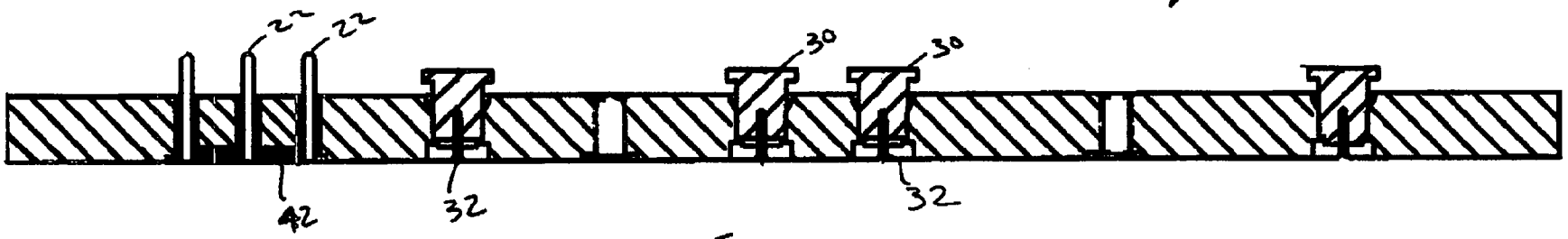
FIG. 3 is a cross section view of another embodiment of a multiple position push-on electrical connector according to the present invention.
Figure 4:
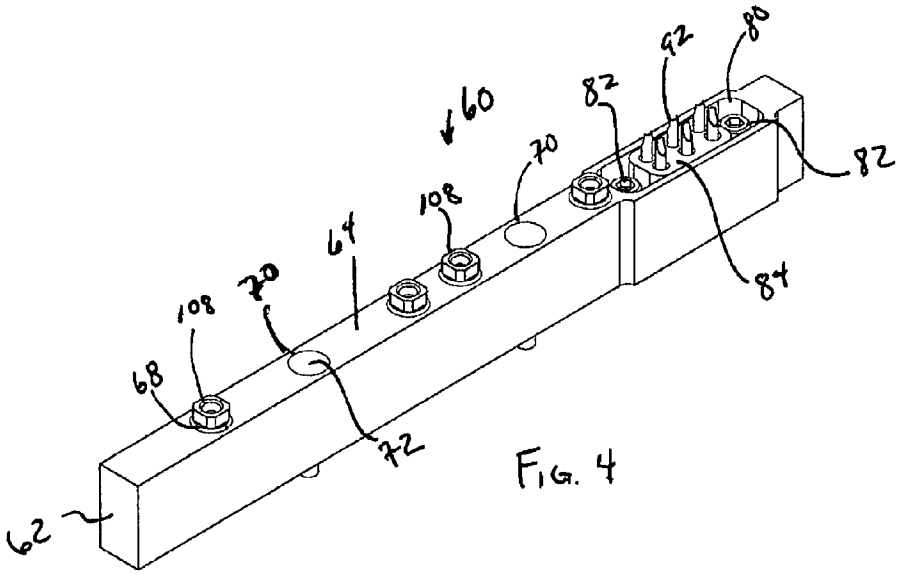
FIG. 4 is a perspective view of from the front of a multiple position push-on electrical mating connector according to the present invention.
Figure 5:
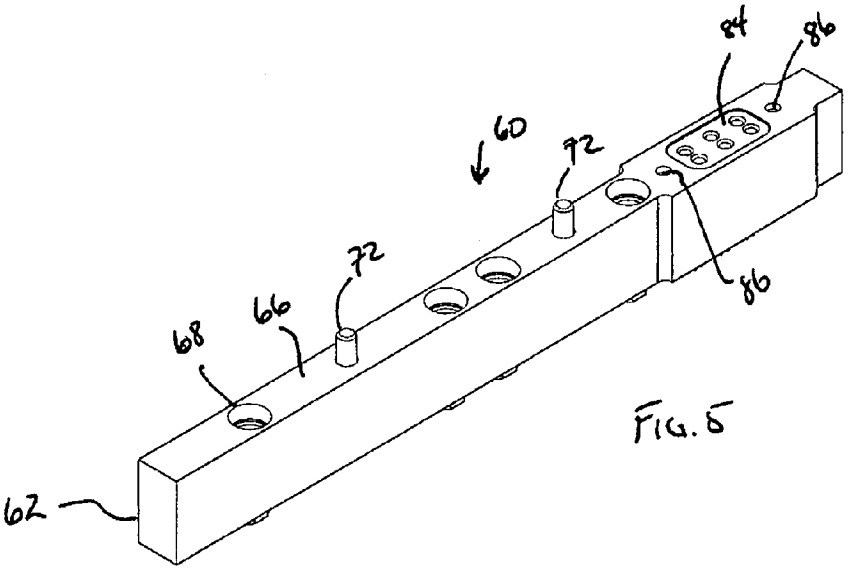
FIG. 5 is a perspective view of the multiple position push-on mating electrical connector of FIG. 4 from the rear.
Figure 6:
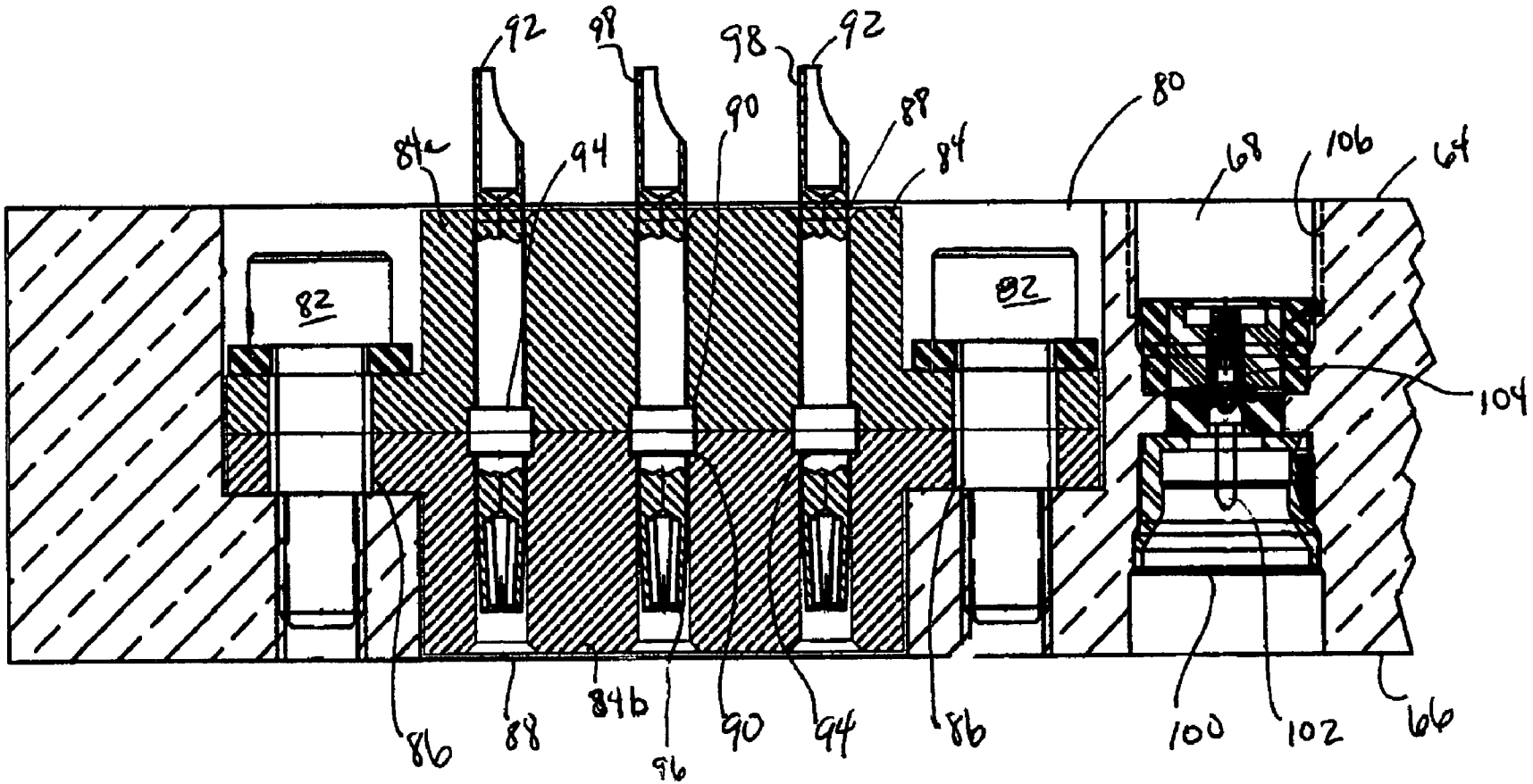
FIG. 6 is an enlarged view of a portion of the multiple position push-on electrical mating connector of FIG. 4.
Figure 7:
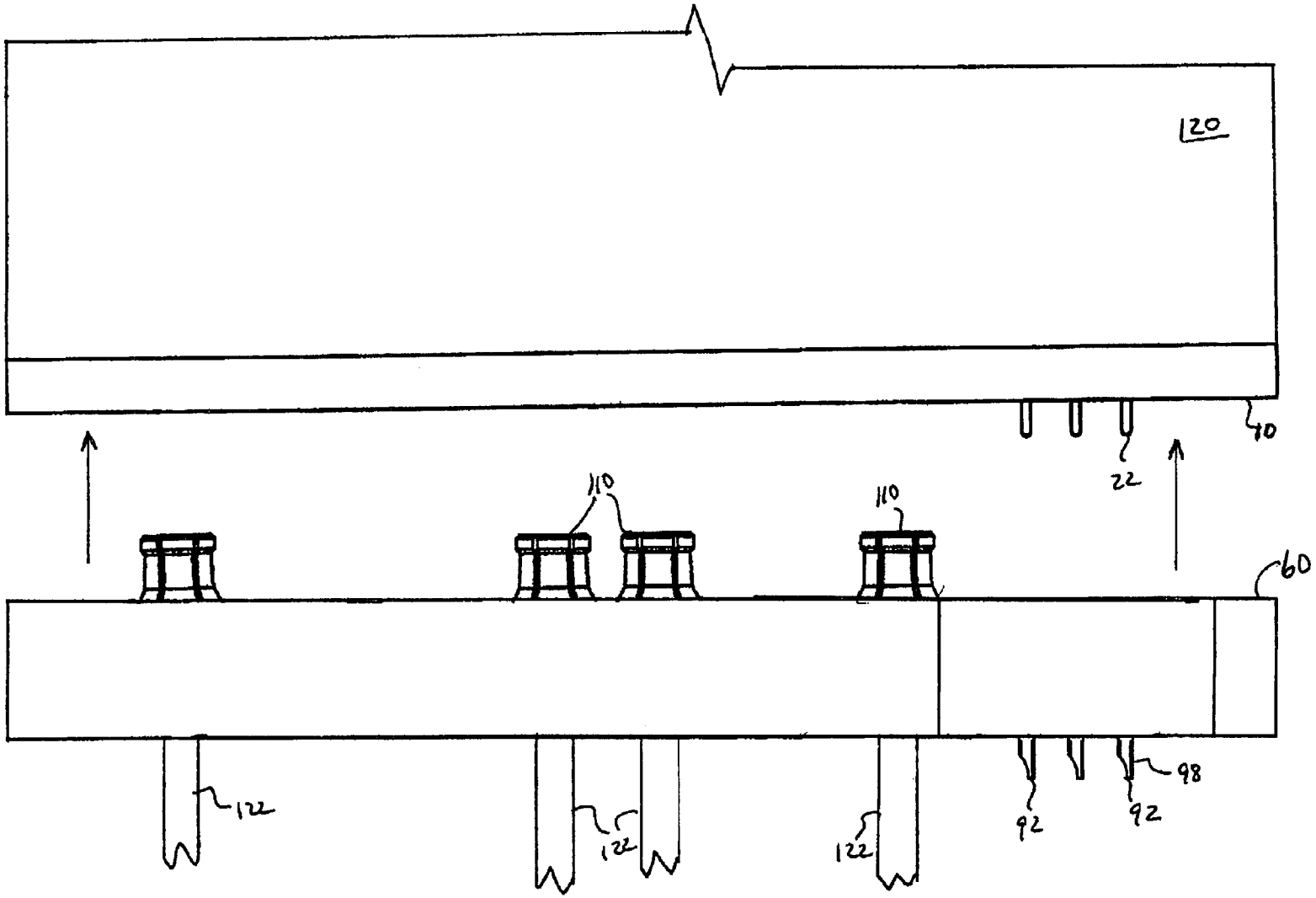
FIG. 7 is a schematic view of the multiple position push-on electrical connector and the multiple position push-on electrical mating connector according to the present invention prior to engagement.
Figure 8:
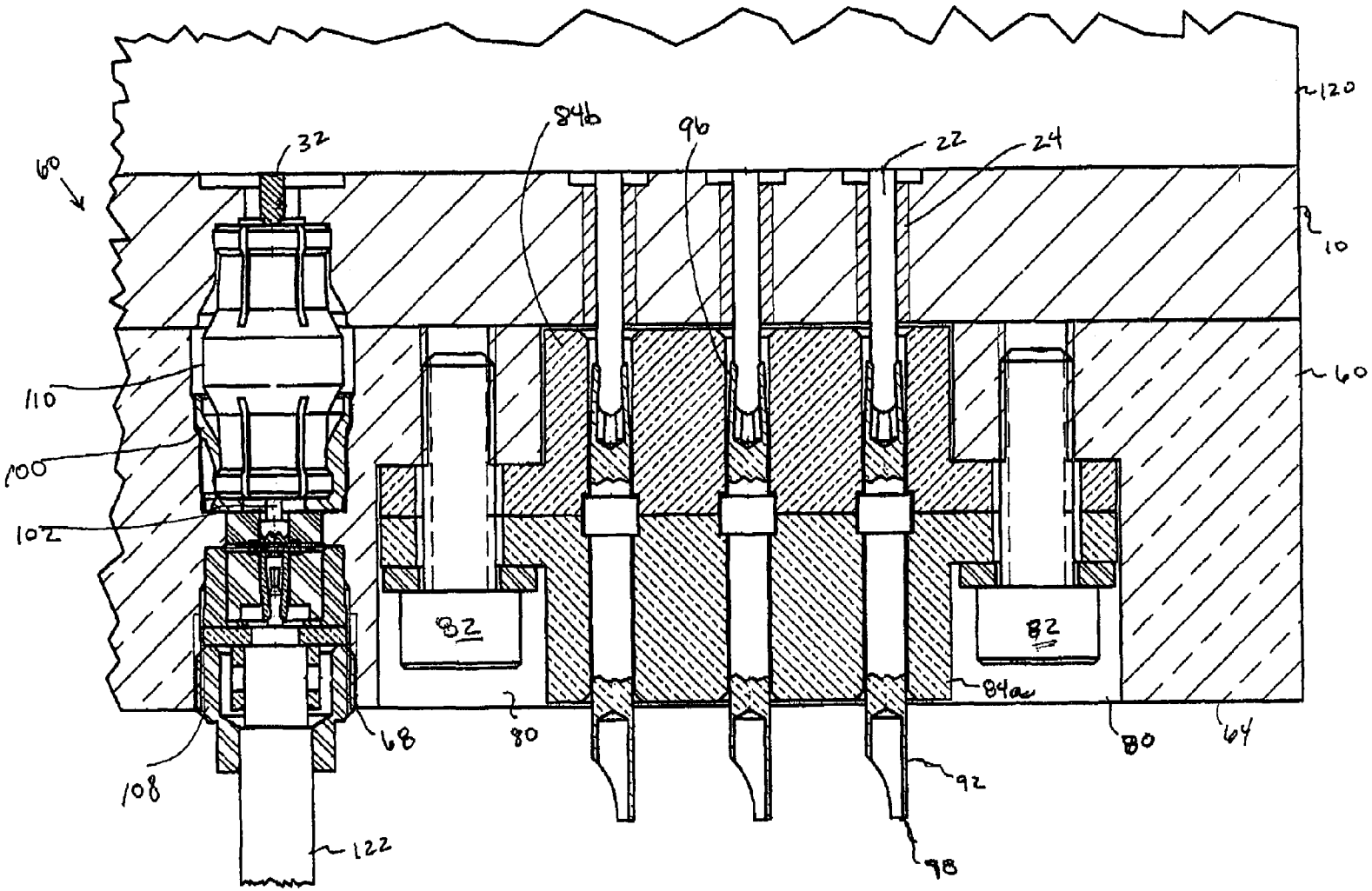
FIG. 8 is a partial cross section view of a portion of a combination of the multiple position push-on electrical connector of FIG. 1 in mating engagement with the multiple position push-on electrical mating connector of FIG. 4 and also with a device.

FIGS. 1 and 2 illustrate one embodiment of a multiple position push-on electrical connector. FIG. 3 illustrates another embodiment of a multiple position push-on electrical connector. FIGS. 4-6 illustrate a multiple position push-on electrical mating connector according to the present invention. FIG. 7 schematically illustrates the multiple position push-on electrical connector and the multiple position push-on electrical mating connector of the present invention prior to engagement. FIG. 8 illustrates in a partial cross section view one embodiment of a multiple position push-on electrical connector in mating engagement with one embodiment of a multiple position push-on electrical mating connector, the multiple position push-on electrical connector also connected with a device.

Referring to FIG. 1, a multiple position push-on electrical connector 10 is illustrated. The multiple position push-on electrical connector 10 includes a housing 12 having a first face 14 and a second face 16. The housing 12 has a first set of bores 18 (18*a*, 18*b*, 18*c*, 18*d*) that extend through the housing 12 between the first face 14 and the second face 16. See FIG.

2. As explained in detail below, the first set of bores 18 are configured to receive coaxial cables therein through the first face 14. Additionally, while four bores are illustrated as being in the first set of bores 18, the first set of bores 18 may have more or fewer bores and they may be of different sizes and/or configurations rather than all being the same as illustrated in FIGS. 1 and 2.

The housing 12 is preferably made from metal and more preferably from Kovar, BeCu, brass, aluminum, or any other appropriate material, especially metals that can be easily machined, and as explained below in more detail, materials that can be brazed or soldered onto a housing, substrate, or module. Moreover, while the housing 12 in FIGS. 1 and 2 is illustrated as generally being a rectangular shape, it is within the scope of the present invention that the housing 12 can be of any appropriate configuration.

The housing 12 also has a second set of bores 20, which are preferably smaller and disposed adjacent to one another proximate one end of the housing 12. The second set of bores 20 preferably each have an electrical conductor or pin 22 secured therein. The pins 22 are preferably secured in and electrically insulated from the housing 12 by an insulator 24. The preferred insulator 24 is Corning glass, which has a coefficient of thermal expansion (CTE) that allows the multiple position push-on electrical connector 10 to be brazed or soldered onto a housing, substrate, or module without adversely affecting the integrity of the insulator 24. Other types of materials for insulators may also be used as long as the CTE of the insulator allows for the brazing or soldering of the multiple position push-on electrical connector 10 to the device. As illustrated in FIGS. 1-2, the pins 22 preferably extend outward beyond the first face 14 of the housing to engage another connector, described below in detail. Each of the pins 22 are also preferably flush with the second face 16 of the housing 12 so that they can be braised or soldered onto the device (housing, substrate, or module) to which the housing 12 is attached. The second set of bores 20 are illustrated as being proximate one end of the housing 12. However, the second set of bores 20 may be distributed throughout (or along in the rectangularly configured embodiment illustrated in FIGS. 1-3) the housing 12. Similarly, the second set of bores 20 may also be grouped together in the center or anywhere in the housing 12.

The housing 12 may also have other openings 26, which may be configured to receive a fastener from a multiple position push-on electrical mating connector, which is described in detail below. The fastener may be a screw, bolt or any other appropriate fastener and the openings 26 may have appropriate threads or other configuration to complement and retain a fastener from the multiple position push-on electrical mating connector to hold the two connectors together, as described in detail below.

In use, the multiple position push-on electrical connector 10 is preferably attached to a housing, substrate, or module. In one particularly common application, the multiple position push-on electrical connector 10 is attached to a printed circuit board (PCB). See, e.g., FIG. 7. The multiple position push-on electrical connector 10 can be, as mentioned above, brazed or soldered onto a portion of the PCB, and in particular, an edge of the PCB. The multiple position push-on electrical connector 10 may also be mechanically attached to the PCB (or other device) with screws or other appropriate fasteners.

If multiple position push-on electrical connector 10 is brazed or soldered on to the device, electrical conductors need to be disposed in each of the bores 18 to make electrical contact between coaxial cables and the device (e.g., the PCB). In one embodiment illustrated in FIG. 2, an alignment plug 30 having an electrical conductor 32 disposed therein is inserted into each of the bores 18. The alignment plug 30 holds the electrical conductor 32 in the center of the bore 18 and the rear of the electrical conductor 32 flush with the second face 16 of the housing 12. In this configuration, the electrical conductors 32 may also be brazed or soldered onto the device with the housing 12 and the pins 22 making electrical contact as discussed in detail below. After the electrical conductors 32 are attached to the device, the alignment plugs 30 are removed from the bores 18. In some embodiments, the alignment plugs 30 are made from PFTE.

Another embodiment of a multiple position push-on electrical connector 40 is illustrated in FIG. 3. The multiple position push-on electrical connector 40 is the same as the multiple position push-on electrical connector 10, except that the pins 22 are all mounted in a single insulator 42, rather than in individual insulators 24 as in the prior embodiment.

A multiple position push-on electrical mating connector 60 is illustrated in FIGS. 4-6. The multiple position push-on electrical mating connector 60 includes a housing 62 that has a first face 64 and a second face 66. The housing 62 has a first set of bores 68 that extend through the housing 62 and are configured to receive coaxial cables therein through the first face 64 Additionally, while four bores are illustrated in the first set of bores 68, the first set of bores 68 may have more or fewer bores (even one bore) and they may be of different sizes rather than all being the same sizes as illustrated in FIGS. 4 and 5. However, it should be noted that since the multiple position push-on electrical mating connector 60 is to be mated with the multiple position push-on electrical connector 10, at least one and preferably all of the bores 68 in housing 62 should be complementary and aligned with a corresponding bore or bores 18 in housing 12. See also FIG. 8.

Preferably, housing 62 also has bores 70 to receive fasteners 72. The fasteners 72 preferably extend out of the housing 62 to engage the multiple position push-on electrical connector (10, 40) as noted above. The fasteners 72 may be screws, machine screws, bolts, or any other appropriate fastener.

Referring to FIG. 6, housing 62 has a opening 80 preferably disposed proximate one end of the housing 62 that extends between the first face 64 and the second face 66. Removably secured in the opening 80 of housing 62 is an insulator 84, which is preferably Coming glass. Insulator 84 is preferably secured in opening 80 by fasteners 82. The fasteners 82 engage housing 62 in conjunction with openings 86 to secure the insulator 84 in the opening 80. As seen in FIG. 6, the insulator 84 is preferably a two-piece insulator having a first piece 84*a* and a second piece 84*b* that together retain and secure electrical conductors 92 in openings 88 therein. The openings 88 in the first piece 84*a* and the second piece 84*b* each have a shoulder 90 configured to engage a corresponding shoulder 94 on the electrical conductors 92. It should be noted, that because the insulator 84 is removable from housing 62, the electrical conductors 92 may be easily replaced as needed.

The electrical conductors 92 preferably have at first end 96 a female configuration to receive and be electrically connected to the pins 22 from the multiple position push-on electrical connector 10. At a second end 98 of the electrical conductors 92 is preferably a solder cup for connection to a DC source for DC power and the low frequency signals associated therewith. As would be known to one of ordinary skill in the art, any appropriate configuration at both the first end 96 and a second end 98 may be used.

Opening 80, while proximate to one end of the housing 62, may be disposed anywhere throughout the housing 62, including for example in the middle of the housing or at the other end. As noted above with respect to bores 68, the opening 80 and electrical conductors 92 should be positioned in a complementary position and aligned with pins 22. Additionally, while not as practical or efficient, each the electrical conductors 92 may be disposed in their own insulator and/or opening as with pins 22 noted above.

Turning now to bores 68 in housing 62 in FIG. 6, a shroud 100 and a male pin contact 102 that are accessible through the second face 66 of the housing 62 are preferably disposed in each of the bores 68. The shroud 100 and the male pin contact 102 make contact with a blind mate interconnect device 110 (see FIG. 7). A female socket contact 104 that makes mechanical and electrical contact with the center conductor of a coaxial cable (not shown) is also disposed in preferably each of the bores 68. The interior surface 106 of housing 62 adjacent the first face 64 of the housing 62 and defining bore 68 is preferably configured to receive and retain a coaxial cable connector 108. See FIG. 4 in one embodiment, the coaxial cable connectors 108 are threaded clamp nuts available from Corning Gilbert Incorporated and which are described in detail in co-pending application Ser. No. 10/967,046 and having a publication in Number of US 2006/0084286 published on Apr. 20, 2006 the contents of which are expressly incorporated herein in their entirety by reference. However, any other appropriate coaxial cable connector may be used.

FIG. 7 schematically illustrates the multiple position push-on electrical connector 10 and the multiple position push-on electrical mating connector 60 just before mechanical and electrical connection with one another. A device 120 which is attached (either mechanically or thermally) to multiple position push-on electrical connector 10 is also illustrated. Blind mate interconnects or bullets 110 are illustrated as being inserted into the bores 68 of the multiple position push-on electrical mating connector 60. Each of the blind mate interconnects or bullets 110 are in electrical communication with a corresponding male pin contact 102 and also with a corresponding center conductor of the coaxial cable 122 connected to the multiple position push-on electrical mating connector 60. Once the multiple position push-on electrical mating connector 60 is pushed in the direction of the arrows in FIG. 7, the coaxial cables 122 will be in electrical contact with the electrical components on device 120. The electrical conductors 92 will also be in contact with the pins 22 and ready to provide power or small wave signals to the device when appropriate connections are made through the solder cups at the second end 98.

FIG. 8 schematically illustrates a portion of the multiple position push-on electrical connector 10 and the multiple position push-on electrical mating connector 60 electrically and mechanically connected to one other and the multiple position push-on electrical connector 10 electrically and mechanically connected to a device 120. As noted above, the device 120 may be housing, substrate, or module.

The multiple position push-on electrical connector 10 is preferably brazed or soldered onto the device 120, with the electrical conductors 32 and 22 also brazed or soldered onto device 120 as well. Although not shown, the electric conductors 32, 22 are in electrical communication with appropriate circuits or electrical conductors associated with device 120. The electrical conductor 32 is in electrical communication with the corresponding center conductor of the coaxial cable 122 through the blind mate interconnects or bullets 110.

The electrical conductors 22, in electrical communication with device 120 and electrically isolated from multiple position push-on electrical connector 10 by insulators 24, electrically engage the first end 96 of electrical conductors 92. The electrical conductors 92 are insulated from and secured in the housing 62 by the first piece 84*a* and second piece 84*b* of insulator 84. The second end 98 of each of the electrical conductors 92 are then electrically connected to a DC power source (not shown).

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A configuration comprising a multiple position push-on electrical connector in electrical and mechanical contact with a multiple position push-on electrical mating connector, wherein the multiple position push-on electrical connector comprises:

a housing having a first face and a second face;

a first set of bores extending through the housing between the first face and the second face, the first set of bores configured to receive blind mate interconnects therein;

a second set of bores extending through the housing between the first face and second face; and a plurality of electrical conductors secured in the second set of bores, each of the plurality of electrical conductors extending beyond the first face of the housing and being electrically insulated from the housing, the plurality of electrical conductors capable of transmitting DC signals through the connector; and the multiple position push-on electrical mating connector comprises:

a housing having a first face and a second face;

a first set of bores extending through the housing between the first face and the second face, each of the first set of bores configured to receive coaxial cable through the first face and further configured to receive a blind mate interconnect through the second face; and a plurality of electrical conductors extending between the first face and the second face for transmitting DC signals through the housing;

and wherein the configuration further comprises blind mate interconnects disposed in the first set of bores of the push-on electrical connector and in the first set of bores of the push-on electrical mating connector.

2. The configuration according to claim 1, wherein the multiple position push-on electrical connector is secured to a device and wherein device is selected from a group that consists of a printed wiring board, a substrate, and a housing.

3. The configuration according to claim 2, wherein an electrical conductor in electrical communication with the device is disposed in each of the first set of bores of the multiple position push-on electrical connector.

4. The configuration according to claim 2, wherein the multiple position push-on electrical connector is thermally secured to the device.

5. The configuration according to claim 2, wherein the multiple position push-on electrical connector is mechanically secured to the device.

6. The configuration according to claim 1, wherein the bores in the second set of bores of the multiple position push-on electrical connector are disposed proximate one end of the housing of the multiple position push-on electrical connector.

7. The configuration according to claim 1, wherein the bores in the second set of bores of the multiple position push-on electrical connector are disposed adjacent one another in the housing of the multiple position push-on electrical connector.

8. The configuration according to claim 1, wherein the bores in the second set of bores of the multiple position push-on electrical connector are distributed throughout the housing of the multiple position push-on electrical connector.

9. The configuration according to claim 1, wherein the plurality of electrical conductors of the multiple position push-on electrical connector are electrically insulated from the housing of the multiple position push-on electrical connector.

10. The configuration according to claim 9, wherein glass is used to electrically insulate the plurality of electrical conductors from the housing of the multiple position push-on electrical connector.

11. The configuration according to claim 1 wherein the multiple position push-on electrical connector further comprises at least one insulating member, each of the plurality of electrical conductors of the multiple position push-on electrical connector being secured in the insulating member, the insulating member insulating the plurality of electrical conductors from one another and the housing of the multiple position push-on electrical connector.

12. The configuration according to claim 1 wherein the multiple position push-on electrical connector further comprises alignment plugs disposed in each of the first set of bores of the multiple position push-on electrical connector, each of the alignment plugs having an electrical conductor disposed therein.

13. The configuration according to claim 1 wherein the multiple position push on electrical mating connector further comprises an insulating member configured to receive and secure the plurality of electrical conductors therein.

14. The configuration according to claim 13, wherein the insulating member is disposed in an opening extending between the first and second faces of the housing of the multiple position push on electrical mating connector.

15. The configuration according to claim 13, wherein the insulating member is removably disposed in the housing of the multiple position push on electrical mating connector.

16. The configuration according to claim 13, wherein each of the plurality of electrical conductors of the multiple position push on electrical mating connector are removably secured in the insulating member.

17. The configuration according to claim 1, wherein a removable connector is disposed in one of the first set of bores of the multiple position push on electrical mating connector, the removable connector extending through the second face of the housing of the multiple position push on electrical mating connector.

* * * * *